US008201643B2

(12) United States Patent
Soby et al.

(10) Patent No.: US 8,201,643 B2
(45) Date of Patent: Jun. 19, 2012

(54) SYSTEM AND METHOD FOR LONGITUDINAL AND LATERAL JETTING IN A WELLBORE

(75) Inventors: Michael Soby, Calgary (CA); Dale Joseph, Houston, TX (US)

(73) Assignee: Semjet Well Technologies LLC, Houston, TX (US)

( * ) Notice: Subject to any disclaimer, the term of this patent is extended or adjusted under 35 U.S.C. 154(b) by 140 days.

(21) Appl. No.: 12/501,001

(22) Filed: Jul. 10, 2009

(65) Prior Publication Data

US 2010/0243266 A1 Sep. 30, 2010

Related U.S. Application Data

(60) Provisional application No. 61/163,697, filed on Mar. 26, 2009.

(51) Int. Cl.
*E21B 7/08* (2006.01)

(52) U.S. Cl. ..... 175/317; 175/61; 166/298; 166/317

(58) Field of Classification Search ..... 166/298, 166/55.7, 222, 223, 318; 175/61, 317
See application file for complete search history.

(56) References Cited

U.S. PATENT DOCUMENTS

| | | | |
|---|---|---|---|
| 3,154,147 | A | 10/1964 | Lanmon, II |
| 3,294,163 | A | 12/1966 | Lebourg |
| 3,562,526 | A | 2/1971 | Lawson |
| 3,799,276 | A | 3/1974 | Matsushita et al. |
| 4,035,639 | A | 7/1977 | Boutemy |
| 4,708,214 | A | 11/1987 | Krawza |
| 4,710,074 | A | 12/1987 | Springer |
| 4,760,883 | A | 8/1988 | Dunn |
| 5,165,491 | A | 11/1992 | Wilson |
| 5,335,724 | A | 8/1994 | Venditto et al. |
| 5,392,858 | A | 2/1995 | Peters et al. |
| 5,413,184 | A | 5/1995 | Landers |
| 5,833,003 | A | 11/1998 | Longbottom et al. |
| 5,853,056 | A | 12/1998 | Landers |
| 5,947,205 | A | 9/1999 | Shy |
| 6,116,343 | A | 9/2000 | Van Petegem et al. |
| 6,125,949 | A | 10/2000 | Landers |
| 6,167,968 | B1 | 1/2001 | Allarie et al. |
| 6,189,629 | B1 * | 2/2001 | McLeod et al. ..... 175/67 |
| 6,209,645 | B1 | 4/2001 | Ohmer |

(Continued)

FOREIGN PATENT DOCUMENTS

| | | |
|---|---|---|
| EP | 752514 | 1/1997 |

(Continued)

*Primary Examiner* — David Bagnell
*Assistant Examiner* — Richard Alker
(74) *Attorney, Agent, or Firm* — Franklin & Associates International LLC; Matthew F. Lambrinos

(57) ABSTRACT

A system and method for enabling longitudinal and radial drilling in a wellbore is described. The system and method enable an operator to perforate the casing of a wellbore with an under-reamer at the end of a drill string and, without removing the drill string from the wellbore, initiate and complete lateral jetting of the wellbore into the surrounding formation. The system utilizes a perforation tool having a ball seat, which upon seating a drop ball in the ball seat enables the perforation tool to move from a closed position to an open position thereby allowing access to the formation using a jetting tool. Prior to seating the drop ball, an under-reaming operation may be performed using a hydraulic pressure activated under-reaming tool.

9 Claims, 6 Drawing Sheets

U.S. PATENT DOCUMENTS 6,263,984 B1 7/2001 Buckman
6,298,915 B1 10/2001 George
6,315,062 B1 11/2001 Alft et al.
6,374,918 B2 4/2002 Roberts et al.
6,378,629 B1 4/2002 Baird
6,412,578 B1 7/2002 Baird
6,435,286 B1 8/2002 Stump et al.
6,523,624 B1 2/2003 Cousins
6,530,439 B2 3/2003 Mazorow
6,550,553 B2 4/2003 Baird
6,578,636 B2 6/2003 Mazorow
6,612,383 B2 9/2003 Desai et al.
6,612,547 B2 9/2003 Carmody et al.
6,668,948 B2 12/2003 Buckman
6,866,106 B2 3/2005 Trueman
6,889,781 B2 5/2005 Mazorow
6,920,945 B1 7/2005 Belew
6,948,561 B2 * 9/2005 Myron ..... 166/240
6,957,701 B2 10/2005 Tolman et al.
6,964,303 B2 11/2005 Mazorow
6,971,457 B2 12/2005 Baird
7,069,996 B2 7/2006 McGarian
7,195,082 B2 3/2007 Adam
7,225,887 B2 6/2007 Kriesels
7,357,182 B2 4/2008 Hunt et al.
7,441,595 B2 10/2008 Jelsma
7,455,127 B2 11/2008 Schick
7,461,707 B2 12/2008 Gard
7,497,259 B2 3/2009 Leising et al.
7,690,443 B2 4/2010 Brunet et al.
7,703,525 B2 4/2010 Wilcox et al.
7,918,279 B2 4/2011 Leising et al.
7,975,780 B2 7/2011 Siher et al.
2001/0035302 A1 11/2001 Desai et al.
2004/0211568 A1 10/2004 Funkhouser
2004/0231850 A1 11/2004 McGarian
2006/0201675 A1 * 9/2006 Ferguson et al. ..... 166/298
2006/0278393 A1 12/2006 Hunt et al.
2007/0012440 A1 * 1/2007 Lee ..... 166/216
2007/0181308 A1 8/2007 Jelsma
2007/0256837 A1 11/2007 Khomynets
2008/0179061 A1 7/2008 McAfee
2009/0288833 A1 11/2009 Graham et al.
2009/0288884 A1 11/2009 Jelsma
2010/0025115 A1 2/2010 Kotsonis et al.
2010/0193192 A1 8/2010 Buckman, Sr.
2010/0252257 A1 10/2010 Cronley et al.
2011/0146989 A1 6/2011 Dotson et al.
2011/0155469 A1 6/2011 Sanfelice et al.
2011/0198087 A1 8/2011 Adam et al.
2011/0247815 A1 10/2011 Jelsma et al.

FOREIGN PATENT DOCUMENTS

EP 978629 A2 2/2000
WO 2011044012 4/2011

* cited by examiner

SYSTEM AND METHOD FOR LONGITUDINAL AND LATERAL JETTING IN A WELLBORE

RELATED APPLICATIONS

This application claims the benefit of priority under 35 U.S.C. §119(e) from U.S. Provisional Patent Application 61/163,697, entitled "System and Method For Longitudinal and Radial Drilling", which was filed Mar. 26, 2009, the disclosure of which is incorporated herein by reference.

FIELD OF THE INVENTION

A system and method for enabling longitudinal and radial drilling in a wellbore is described. The system and method enable an operator to perforate the casing of a wellbore with an under-reamer at the end of a drill string and, without removing the drill string from the wellbore, initiate and complete radial drilling of the wellbore into the surrounding formation. The system utilizes a perforation tool having a ball seat, which upon seating a drop ball in the ball seat enables the perforation tool to move from a closed position to an open position thereby allowing access to the formation using a jetting tool. Prior to seating the drop ball, an under-reaming operation may be performed using a hydraulic pressure activated under-reaming tool.

BACKGROUND OF THE INVENTION

Oil and gas wells are drilled vertically down into the earth strata with the use of rotary drilling equipment. A tube known as casing is placed down into the well after it is drilled in order to provide stability to the drill hole for and during the subsequent recovery of hydrocarbons from the well. The casing defines the cross-sectional area of the well for transportation of oil and gas upwardly from the well. The casing is usually made of steel and is generally 4.5-8 inches in external diameter and 4-7.5 inches in internal diameter. The casing may hang freely in portions of the well and will often be cemented in place with grout and/or cement. As is well known, after casing a well, the cased well must be perforated through the casing to permit formation fluids to enter the casing from any zones of interest adjacent to the casing.

In addition to simply perforating a well and allowing formation fluids to flow into the well, well production can be improved by subjecting the well and producing formations to fracturing operations in which fractures are induced in the formation using high pressure pumping equipment. Further still, other drilling methods such as horizontal or directional drilling may be employed to enhance hydrocarbon recovery.

However, each of these technologies can be extremely costly such that the cost presents a significant barrier to enhanced production in some applications. Moreover, such techniques may not be able to exploit thin production horizons. Generally, the limitations of these production enhancement technologies results in what the industry refers to as by-passed production.

As a result, there has been a need for systems and methods to effectively enhance production of reservoirs beyond that which may be achieved through simply perforating a well or by the very expensive fracturing or horizontal or directional drilling techniques. In particular, there has been a need for systems and methods that can effectively enhance production and at a cost significantly below that of many past techniques.

More specifically, there has been a need for improved radial or longitudinal drilling in which the well casing can be effectively penetrated in a radial direction to the longitudinal axis of the well to gain access to the surrounding earth strata. Radial access to the formation has been achieved by various techniques including fluid jetting. While fluid jetting is a known technique, there continues to be a need for systems that improve the overall efficiency of such techniques and, in particular, the ability to enable radial jetting by minimizing the number of steps in the overall process of perforating a well and subsequently performing a radial fluid jetting operation.

A review of the prior art reveals that a number of technologies have been utilized in the past. For example, U.S. Pat. No. 6,971,457 describes a method for drilling holes in casing using a multiple U-Joint method. This method allows the jetting tool to be located down well in a different slot than the casing perforator, wherein it can then be used once the perforation is made.

U.S. Pat. No. 6,920,945 also describes a method for drilling holes in casing using a multiple U-Joint method. In this case, once the perforation is drilled, the perforation device is removed and a flexible tube is inserted to penetrate the perforation and jet drill the formation.

Other patents include U.S. Pat. No. 6,550,553 which describes a method for drilling holes in casing using a multiple U-Joint method; U.S. Pat. No. 6,523,624 which describes a method for drilling holes in casing using a flexible spline drive and a cutter to cut holes in casing; U.S. Pat. No. 6,378,629 which describes a method for drilling holes in casing using a multiple U-Joint method; U.S. Pat. No. 6,189,629 which describes a jet cutting tool rotatable in the downhole position allowing for multiple radial drills in which the jet drilling tool erosion drills the casing using a fluid and an abrasive; U.S. Pat. No. 5,853,056 that describes a ball cutter to drill the casing; U.S. Pat. No. 7,441,595 describing an alignment tool to ensure that multiple passage ways can be accessed; and U.S. Pat. No. 7,195,082 describing a directional control system to work with a jet drilling system.

In addition, U.S. Pat. Nos. 6,964,303; 6,889,781; 6,578,636 describe drilling systems for porting a casing and using a jet drilling system for formation drilling.

Further still, U.S. Pat. No. 6,668,948 describes a jet drilling nozzle with a swirling motion applied to the fluid; U.S. Pat. No. 6,530,439 describes a jet drilling hose and nozzle assembly with thruster jets incorporated in the hose to advance the drilling hose during the drilling process; U.S. Pat. No. 6,412,578 describes a multiple U-Joint casing boring technology; U.S. Pat. No. 6,263,984 describes a rotating and non-rotating jet drilling nozzle system; U.S. Pat. Nos. 6,125,949 and 5,413,184 describe a ball cutter for drilling a window in the casing and using a jet drilling assembly for drilling the formation; and, U.S. Pat. No. 4,708,214 describes a jet drilling nozzle assembly.

While the prior art may provide a partial solution, each are limited in various ways as briefly discussed below.

In particular, past systems may be limited by the practical effectiveness of the system downhole or by inherent problems in the design of the systems. Such problems may include the strength, durability and accuracy of a flexible shaft and/or the effectiveness of a ball cutter. Other problems include the number of steps required, the complexity of the systems and, hence the maintenance costs associated with such systems.

Abrasive jet techniques and rotary techniques may be further limited in narrow casing ID's deployments and problems of ports that introduce potential tear/binding points.

SUMMARY OF THE INVENTION

In accordance with the invention, there is provided a lateral jetting system for providing access for a jetting tool to a downhole formation comprising: a body adapted for attachment to a drill string, the body having a jetting orifice; a sliding sleeve slidingly retained within the body, the sliding sleeve having a fluid channel for enabling fluids to flow from an uphole side of the sliding sleeve to a downhole side of the sliding sleeve; a plug seat within the fluid channel for receiving a plug to seal the fluid channel; a jetting trough uphole of the plug seat for enabling a jetting hose to be radially deflected from the sliding sleeve wherein the sliding sleeve is operable between a closed position where the jetting trough is not aligned with the jetting orifice and an open position where the jetting trough is aligned with the jetting orifice; and, a shear pin for retaining the sliding sleeve in the closed position; wherein hydraulic pressure applied to the sliding sleeve will cause the shear pin to shear such that the sliding sleeve will move from the closed position to the open position when a plug is seated against the plug seat.

In further embodiments, the fluid channel is sequentially defined by the jetting trough, a circumferential groove on the exterior of the sliding sleeve, a side port and a central throughbore in fluid communication with one another. Preferably, the circumferential groove is adjacent a lower end of the jetting trough and/or the plug is a drop ball.

In another embodiment, the body includes a corresponding circumferential groove to the circumferential groove which together collectively define a generally circular circumferential groove size to permit the passage of the drop ball therethrough.

In yet another embodiment, the system includes at least two dogs diametrically positioned on the body for biasing the body to a central position in a wellbore.

In another embodiment, the system further comprises at least one o-ring operatively connected to the sliding sleeve and body for sealing between the sliding sleeve and body.

In another aspect of the invention, a method for radial jetting a well bore in a system having an under-reamer and lateral jetting system as above is provided, the method comprising the steps of: a) applying a hydraulic pressure to an upper surface of the under-reamer tool to effect under-reaming and access to a formation; b) introducing a drop ball to the drill string and pumping the drop ball to effect seating of the drop ball within the ball seat and block the passage of fluid to the under-reamer; c) increasing hydraulic pressure within the drill string to shear the shear pin and cause the sliding sleeve to move from the closed position to the open position; d) advancing a jet hose in the drill string such that the jet hose seats within the jetting trough and is radially deflected along the jetting trough to the jetting orifice; and e) conducting lateral jetting with the jet hose.

BRIEF DESCRIPTION OF THE DRAWINGS

The invention is described with reference to the accompanying figures in which.

DETAILED DESCRIPTION OF THE INVENTION

With reference to the figures a downhole tool system enabling lateral jetting from within well casing is described.

Figure 1:
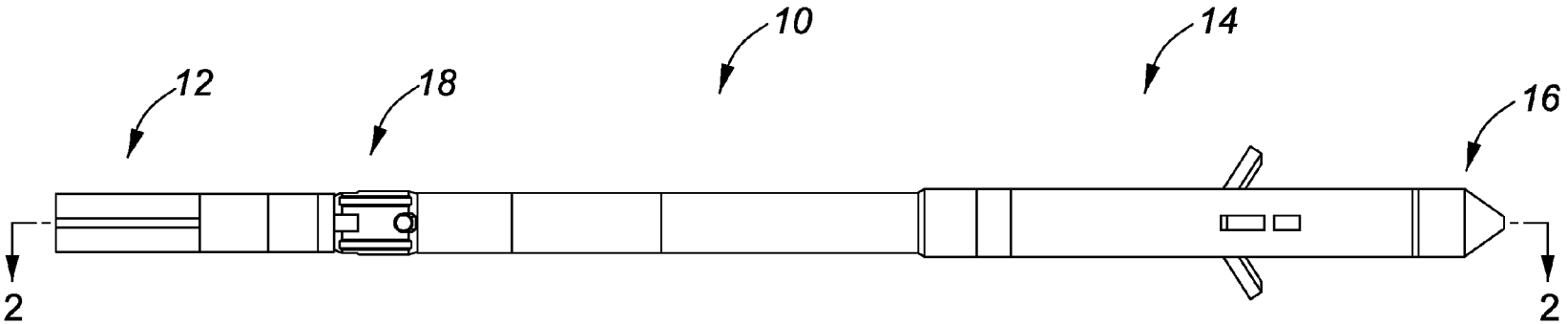
FIG. 1 is a plan view of an assembled downhole tool in accordance with one embodiment of the invention.
Figure 2:
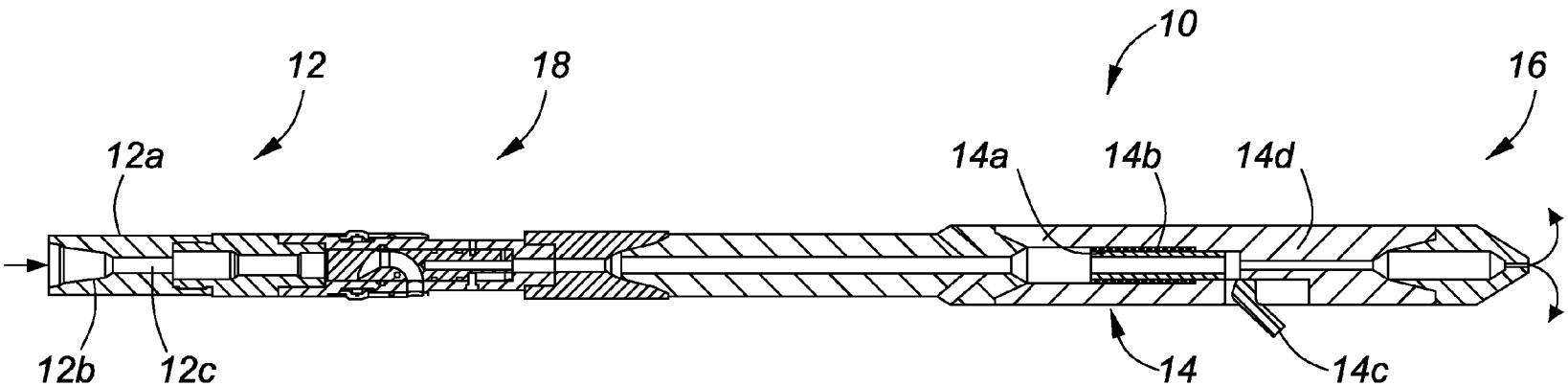
FIG. 2 is a cross-sectional view of an assembled downhole tool in accordance with one embodiment of the invention.
Figure 3:
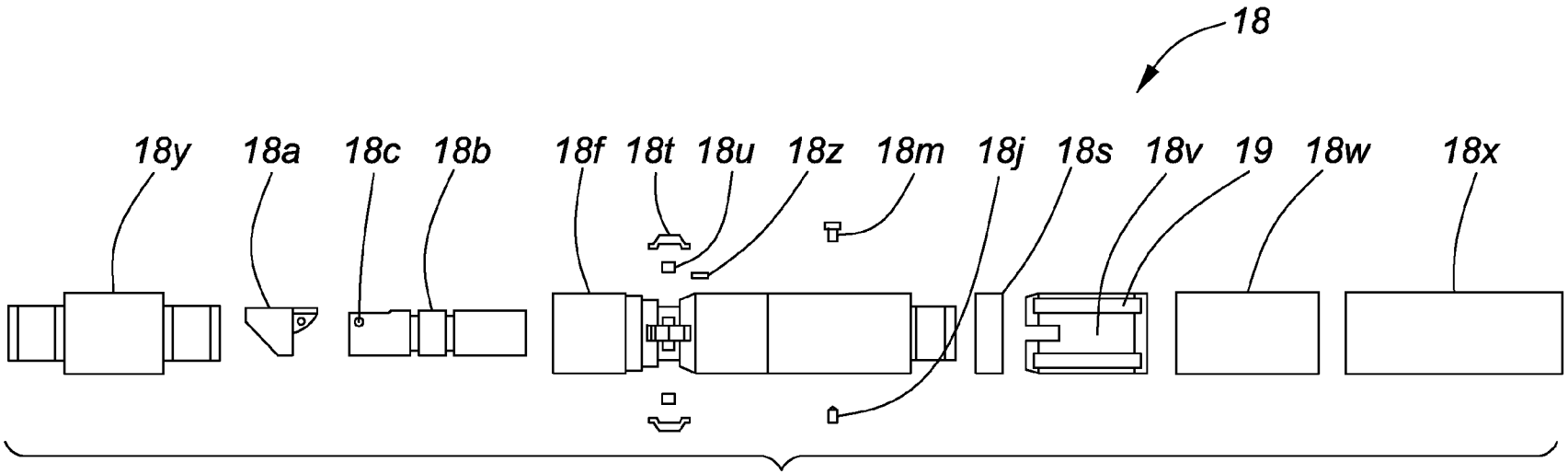
FIG. 3 is an exploded view of a lateral jetting system in accordance with one embodiment of the invention.

As shown in FIGS. 1 and 2, a lateral jetting system 10 includes a lateral jetting section (LJS) 18, an under-reamer section 14, a bullnose 16 and a crossover sub 12.

Overview

In an operation to under-ream and laterally jet a cased well, the system 10 is attached to a drill/coiled tubing string (not shown) using the crossover over sub 12. The LJS 18 is attached to the cross-over sub and the LJS is attached to the under-reamer 14 which in turn is attached to the bullnose 16.

The system 10 is pushed into the well to a desired depth and drilling fluid is circulated down through the coiled tubing, through the cross-over sub, LJS, under-reamer and out through the bullnose as shown in FIG. 2.

At the commencement of the under-reaming operation, the operator increases the flow rate of drilling fluid through the system such that hydraulic pressure acting on piston surface 14*a* overcomes spring 14*b* and causes milling arms 14*c* to pivot outwardly and engage with the well casing. The combined hydraulic pressure and rotation of the drill string will cause the milling arms to mill the casing so as to create a milled passage to the formation through the casing.

After completing the under-reaming operation, hydraulic pressure is released and the milling arms will retract into the under-reamer under the action of spring 14*b*.

The system is then lowered further into the well such that the LJS is substantially aligned with the milled passage.

At surface, a drop ball is then introduced into the coiled tubing where it is allowed to fall by gravity and hydraulic fluid pressure such that the drop ball moves to the LJS where the drop ball then becomes lodged or seated within the LJS and blocks the passage of fluid through the LJS to the under-reamer.

Hydraulic fluid pressure is then increased to a level that then causes a shear pin within the LJS to shear, thereby causing a sliding sleeve within the LJS to displace downhole such that an LJS jetting port is opened.

Once the LJS jetting port is opened, a jetting hose and tool is lowered down the drill string through the jetting port wherein radial jetting using the jetting tool can be performed.

The various sub-components of the system and their operation are described in greater detail below and with reference to the Figures.

Crossover Sub 12

The crossover sub 12 includes an upper body 12*a* having an appropriate connection system 12*b* for attachment to a drill string. The crossover sub has a throughbore 12*c* to allow a jet hose (not shown) and cutting/milling fluid to pass through the tool to the LJS.

Lateral Jetting System 18

As shown in FIGS. 3 and 4A, 4B and 4C, the LJS 18 includes a sliding top sleeve 18*a* that is joined to the top of a sliding sleeve 18*b* by a dowel pin 18*c*. The top end of the sliding top sleeve 18*a* is a guide to funnel a jetting hose and drop ball (not shown) into the sliding sleeve. The sliding top sleeve 18*a* is telescopically seated within lower body 18*f*.

The bottom end of the sliding top sleeve includes a curved surface that forms a top side of a jetting trough 18*d*. The jetting trough guides the jetting hose as it transitions (extends)

from the well bore into the formation through a side port 19*a*. The sliding top sleeve and sliding sleeve are separate pieces to enable manufacturing of the curved surface.

As noted a dowel pin 18*c* is used to connect the sliding top sleeve to the sliding sleeve. Once assembled these three components form the jetting trough that preferably is a rounded quarter circular groove. The sliding sleeve also includes a side port groove 18*e* that is a semi-circular groove that wraps approximately 90 degrees around the exterior body of the sliding sleeve from the bottom end of the jetting trough to a side port 18*h*. A corresponding generally semi-circular groove 18*g* is located on the inside of the lower body 18*f* wherein the two semi-circular grooves define a fluid path from the lower end of the jetting trough to the side port 18*h*. By virtue of their semi-circular shape, these grooves also form the pathway for the drop ball. Thus, the normal fluid path through the tool is circuitous as fluid initially is deflected outwardly along the jetting trough, circumferentially around the sliding sleeve and back towards the middle of the sliding sleeve where it continues longitudinally through bore hole 18*o* in the center of the sliding sleeve 18. The purpose of the circuitous path is to eliminate any lipped surfaces that might otherwise impede a jetting hose along the curved surface of the jetting trough.

The lower body 18*f* includes lower body port 21 that provides a passageway for a jetting hose from the sliding top sleeve through the lower body to the formation.

Figure 5A:
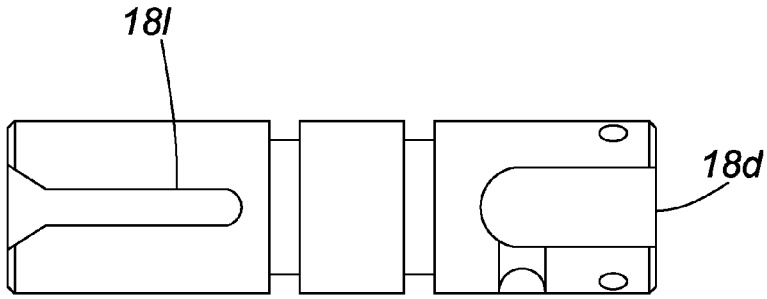
Figures 5B, 5D, 5E:
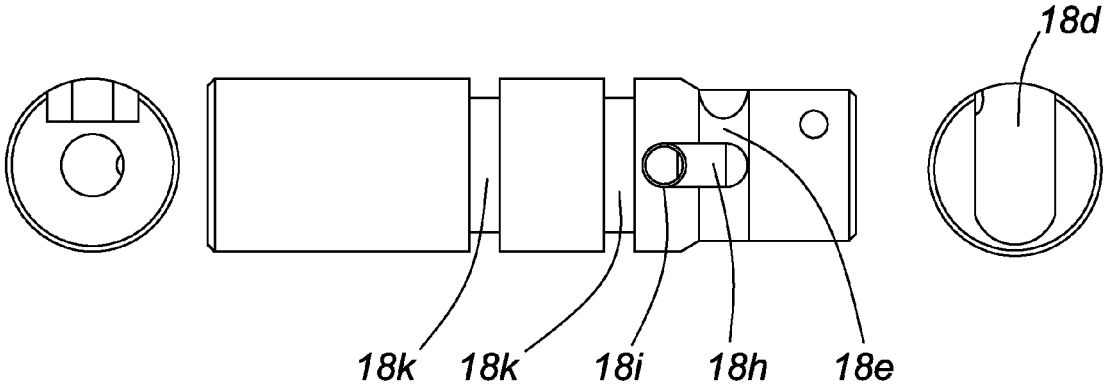
Figure 5C:
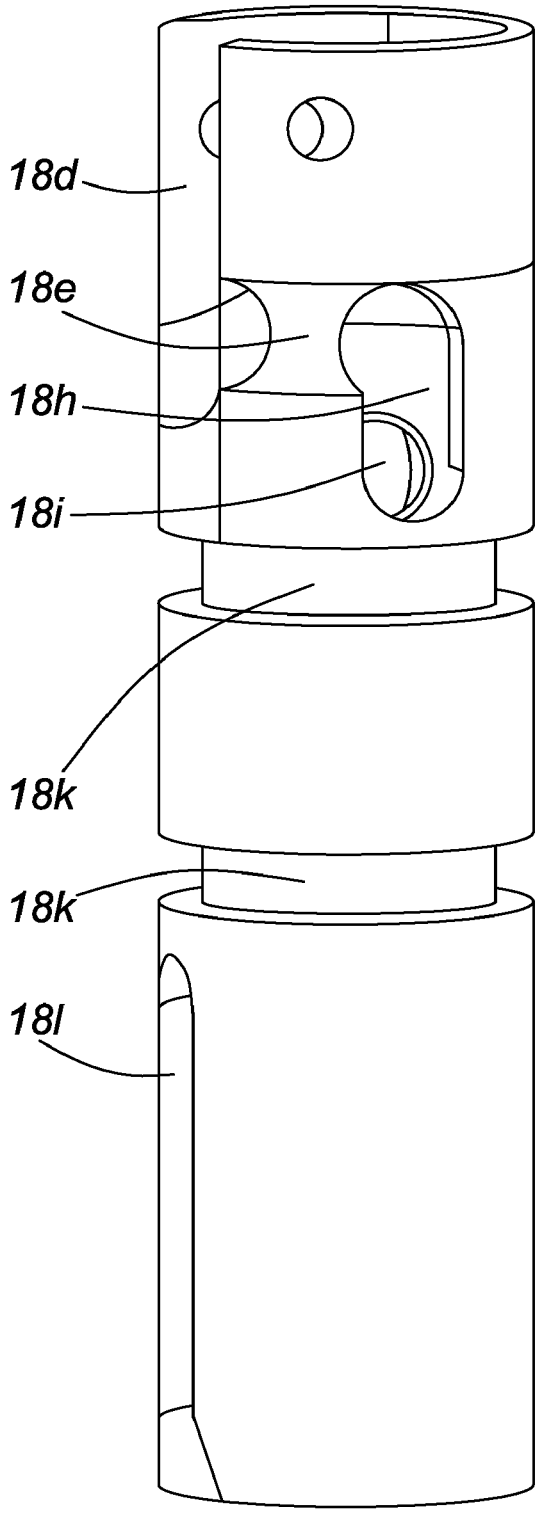

In operation, when the drop ball is dropped into the downhole assembly, the drop ball follows the path of the fluid and eventually reaches the LJS where it passes along the curved surface 18*d*, around grooves 18*e*, 18*g* into ball well 18*h* and seats in ball portal or seat 18*i* (FIG. 5).

Once the drop ball is seated, fluid flow is blocked to the under-reamer tool and with continued pumping of drilling fluid there is a build up of pressure above the sliding sleeve 18*b*. This pressure buildup causes shear pin 18*j* to shear allowing the sliding sleeve to shift downward from a closed position (FIG. 4A) into an open position (FIG. 4B) that enables lateral jetting.

Figure 4A:
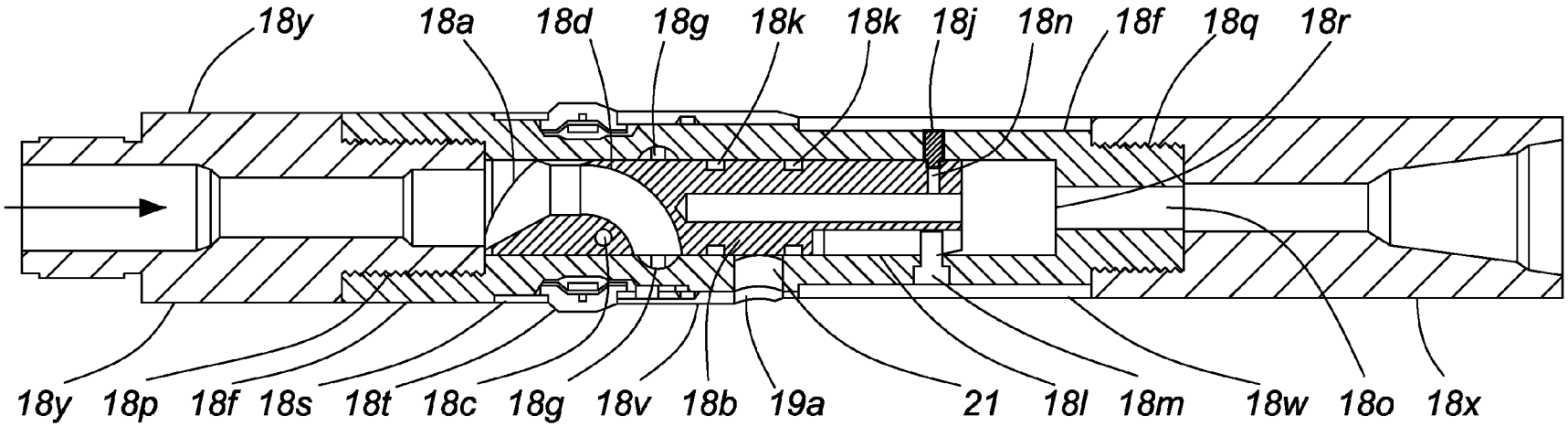
FIGS. 4A and 4B are a cross-sectional views of a lateral jetting system of the downhole tool showing the system in closed and open positions respectively in accordance with one embodiment of the invention.
Figure 4B:
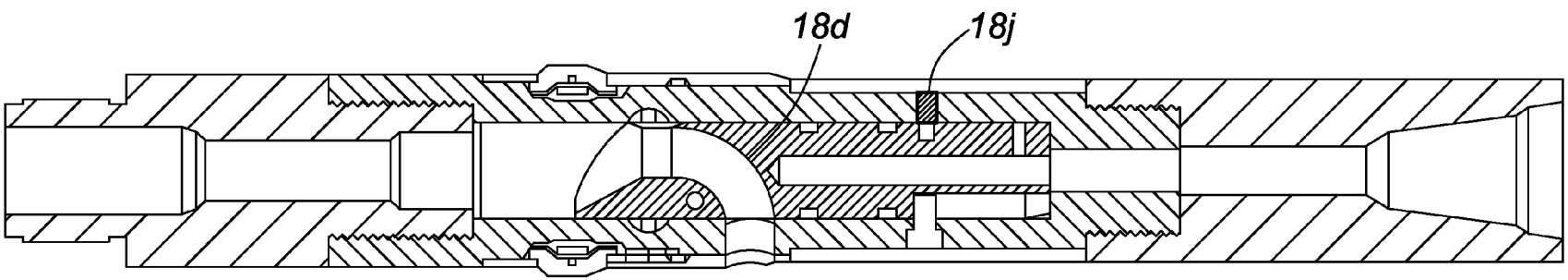
Figure 4C:
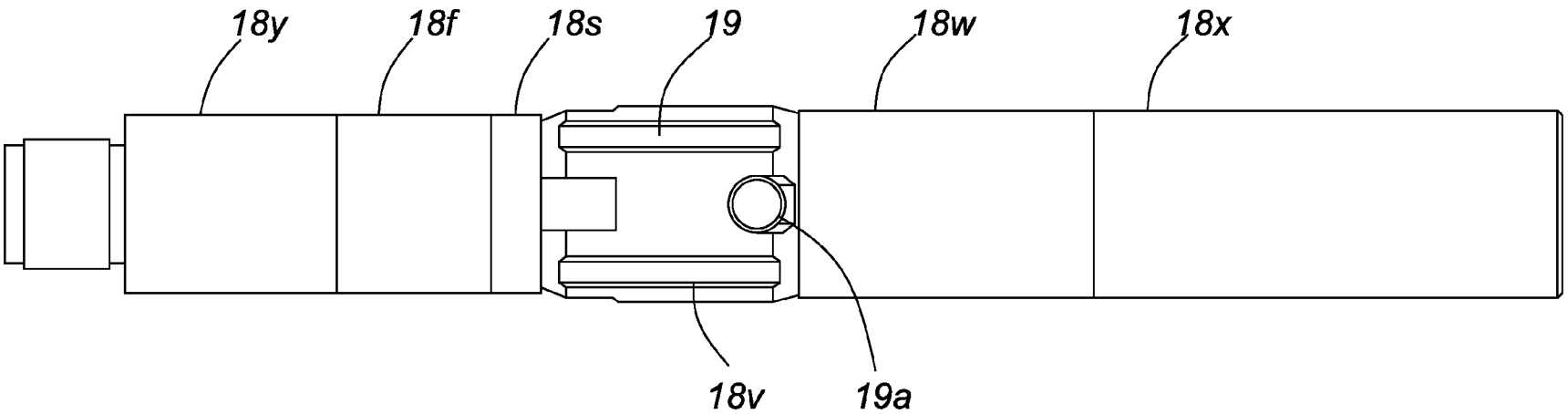
FIG. 4C is a side view of a lateral jetting system in accordance with one embodiment of the invention; and, FIGS. 5A-5E are plan, side, perspective, top, and bottom and perspective views respectively of a sliding sleeve of a lateral jetting system in accordance with one embodiment of the invention.

That is, as shown in FIGS. 4A and 4B, in FIG. 4A, the sliding sleeve 18*b* is uphole with the shear pin 18*j* intact and the jetting trough 18*d* not aligned with lower port groove 18*h* (closed position). FIG. 4B shows the sliding sleeve 18*b* in the downhole position wherein shear pin 18*j* has been sheared such that the jetting trough 18*d* is aligned with the lower port groove 18*h* (open position).

In the mid section of the sliding sleeve are two O-ring grooves 18*k* for containing corresponding O-rings (not shown) that seal the topside of the downhole assembly from the bottom side during this transition period. Below the O-ring grooves is an alignment pin groove 18*l*. The alignment pin groove mates with an alignment pin 18*m* which together keep the sliding sleeve in the proper orientation after the shear pin has been sheared.

Near the bottom of the sliding sleeve is a mating shear pin hole 18*n* that acts as a seat and knife edge for the shear pin. Inside the sliding sleeve there is also a bore hole 18*o* that allows the milling fluid to flow through this component before the drop ball is dropped as described above.

The drop ball is a precision ground sphere that seats into the ball portal 18*i* to commence the chain of events that cause the sliding sleeve to transition from the milling mode (closed position) into the lateral jetting mode (open position).

The lower body 18*f* also has upper threads 18*p* that connect with upper body 18*y* and lower threads 18*q* that connect into a lower body cap 18*x* which in turn connect to the under-reamer or another tool. Internally the lower body 18*f* has a bore 18*r* for accommodating the sliding sleeve components.

In addition, the LJS includes a slip cage retainer 18*s* that is slid over the outside of the lower body. The slip cage retainer secures at least two dogs, preferably four dogs 18*t*, dog springs 18*u* and slip cage 18*v*. The dogs serve as well bore centralizers and the dog springs 18*u* apply outward pressure to the dogs. The dogs may also provide positive feedback to the operator when engaged with milled casing to verify the correct position of the LJS with respect to the milled casing.

A spacer sleeve 18*w* and slip cage retainer 18*s* align and secure the slip cage 18*v* against lower body cap 18*x*. The slip cage retainer 18*s* also secures the top edge of the four dogs and the slip cage. The slip cage has four rectangular windows to incorporate the dogs. These windows secure the dogs so that they are 90° apart.

The slip cage also has four wide ribs 19 that help centralize the downhole assembly while still allowing fluid to flow past the assembly. The slip cage also has a round portal 19*a* which aligns with the portal in the lower body and the jetting trough in the sliding sleeve.

In line with the portal is a keyway on the outside barrel of the lower body. This keyway and mating key 18*z* ensure that the slip cage is installed in the correct orientation.

The shear pins are made from a material with the appropriate shear strength to allow the sliding sleeve to slide at the desired fluid pressure after the drop ball has been dropped.

As noted above, the lower body cap 18*x* is a crossover between the LJS 12 and the under-reamer tool. The top of the lower body cap has an appropriate thread and the bottom of the lower body cap has an appropriate thread such as a 2⅜" API box thread. The top end of the under-reamer 14 has a corresponding 2⅜" API Pin thread.

Under-Reamer

As described above, the under-reamer 14 is used to mill out the well casing at the specified depth. The under-reamer upper body 14*e* consists of a mandrel having appropriate threads (eg. a 2⅜" API pin thread on the top). This API thread threads into the bottom of the LJS 12. The mandrel threads into an under-reamer lower body 14*d*. As known to those skilled in the art, the under-reamer will preferably include a set of backwards facing wash jets to divert some of the drilling fluid to the outside of the under-reamer. This fluid is used to wash milled chips into the sump of the well. The piston 14*a* applies pressure to deploy the milling arms under hydraulic fluid pressure such that a differential is created between the piston and the under-reamer lower body. The piston sits on compression spring 14*b* that is used to return the piston to its retracted state after milling is completed.

The milling arms 14*c* are knife arms with carbide inserts on both the top and bottom sides of the milling arms. The milling arms are pinned to the under-reamer lower body and can pivot about this pin.

Typical Thread Dimensions

The top of the LJS has appropriate connector threads such as a 2.75 Stub ACME box thread that threads into the bottom of the crossover sub 12 at the top of the tool string. The bottom of the LJS has a 2⅜" API thread that threads into the top of the under-reamer tool 14.

The bullnose 16 has a 2⅜" API Pin thread on the top that threads into the bottom of the under-reamer.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A lateral jetting system for providing access for a jetting tool to a downhole formation comprising:

a body adapted for attachment to a drill string, the body having a jetting orifice;

a sliding sleeve slidingly retained within the body, the sliding sleeve having a fluid channel for enabling fluids to flow from an uphole side of the sliding sleeve to a downhole side of the sliding sleeve; a plug seat within the fluid channel for receiving a plug to seal the fluid channel; a jetting trough uphole of the plug seat for enabling a jetting hose to be radially deflected from the sliding sleeve wherein the sliding sleeve is operable between a closed position where the jetting trough is not aligned with the jetting orifice and an open position where the jetting trough is aligned with the jetting orifice; and, a shear pin for retaining the sliding sleeve in the closed position;

wherein hydraulic pressure applied to the sliding sleeve will cause the shear pin to shear such that the sliding sleeve will move from the closed position to the open position when a plug is seated against the plug seat.

2. A system as in claim 1 wherein the fluid channel is sequentially defined by the jetting trough, a circumferential groove on the exterior of the sliding sleeve, a side port and a central throughbore in fluid communication with one another.

3. A system as in claim 2 wherein the circumferential groove is adjacent a lower end of the jetting trough.

4. A system as in claim 3 wherein the plug is a drop ball.

5. A system as in claim 4 wherein the body includes a corresponding circumferential groove to the circumferential groove which collectively define a generally circular circumferential groove sized to permit the passage of the drop ball therethrough.

6. A system as in claim 1 further comprising at least two dogs diametrically positioned on the body for biasing the body to a central position in a wellbore.

7. A system as in claim 1 further comprising at least one o-ring operatively connected to the sliding sleeve and body for sealing between the sliding sleeve and body.

8. A system as in claim 1 further comprising an alignment pin groove for operative alignment of the body relative to the sliding sleeve.

9. A method for radial jetting a well bore in a system having an under-reamer tool and a lateral jetting system comprised of: a body adapted for attachment to a drill string, the body having a jetting orifice; a sliding sleeve slidingly retained within the body, the sliding sleeve having a fluid channel for enabling fluids to flow from an uphole side of the sliding sleeve to a downhole side of the sliding sleeve; a plug seat within the fluid channel for receiving a plug to seal the fluid channel; a jetting through uphole of the plug seat for enabling a jetting hose to be radially deflected from the sliding sleeve wherein the sliding sleeve is operable between a closed position where the jetting trough is not aligned with the jetting orifice and an open position where the jetting trough is aligned with the jetting orifice; and, a shear pin for retaining the sliding sleeve in the closed position; wherein hydraulic pressure applied to the sliding sleeve will cause the shear pin to shear such that the sliding sleeve will move from the closed position to the open position when a plug is seated against the plug seat, wherein the method comprises the steps of:

a. applying a hydraulic pressure to an upper surface of the under-reamer tool to effect under-reaming and access to a formation;

b. introducing a drop ball to the drill string and pumping the drop ball to effect seating of the drop ball within the ball seat and block the passage of fluid to the under-reamer;

c. increasing hydraulic pressure within the drill string to shear the shear pin and cause the sliding sleeve to move from the closed position to the open position;

d. advancing a jet hose in the drill string such that the jet hose seats within the jetting trough and is radially deflected along the jetting trough to the jetting orifice; and, e. conducting lateral jetting with the jet hose.

* * * * *